US006604964B2

(12) United States Patent
Hoshino et al.

(10) Patent No.: US 6,604,964 B2
(45) Date of Patent: Aug. 12, 2003

(54) SHIELDED CONNECTOR ASSEMBLY

(75) Inventors: Hirokazu Hoshino, Saitama (JP); Junya Tsuji, Tokyo (JP); Takashi Futatsugi, Tokyo (JP)

(73) Assignee: Tyco Electronics AMP K.K., Kanagawa (JP)

( * ) Notice: Subject to any disclaimer, the term of this patent is extended or adjusted under 35 U.S.C. 154(b) by 0 days.

(21) Appl. No.: 10/061,799

(22) Filed: Feb. 1, 2002

(65) Prior Publication Data

US 2002/0102880 A1 Aug. 1, 2002

(30) Foreign Application Priority Data

Jan. 31, 2001 (JP) ..... 2001-024483

(51) Int. Cl.[7] ..... H01R 13/648
(52) U.S. Cl. ..... 439/607; 439/608
(58) Field of Search ..... 439/607, 608, 439/609, 610, 108

(56) References Cited

U.S. PATENT DOCUMENTS 5,238,414 A 8/1993 Yaegashi et al. ..... 439/108
5,487,682 A 1/1996 Miller et al. ..... 439/607
5,584,727 A 12/1996 Miller et al. ..... 439/607
5,586,911 A 12/1996 Miller et al. ..... 439/607
RE35,896 E * 9/1998 Brunker et al. ..... 439/108
5,876,248 A * 3/1999 Brunker et al. ..... 439/608
6,206,730 B1 * 3/2001 Avery et al. ..... 439/609
6,210,226 B1 * 4/2001 Zhu et al. ..... 439/607
6,361,365 B1 * 3/2002 Yu ..... 439/607

* cited by examiner

*Primary Examiner*—Ross Gushi
(74) *Attorney, Agent, or Firm*—Barley, Snyder, Senft & Cohen, LLC

(57) ABSTRACT

A board mount type shielded connector assembly comprising an insulating housing having integral tine holding parts. First contacts having first contact parts and first tine parts. Second contacts having second contact parts having a length greater than the first contact parts and disposed alternately in a row with the first contact parts in the insulating housing. The second contacts have second tine parts offset from the first tine parts and positioned substantially adjacent to the first tine parts in a direction perpendicular to the row. A shielding plate having a shielding surface extends in a direction perpendicular to the row and is attached to the insulating housing so that the shielding surface is disposed between the first and second tine parts as a result of the offset of the second tine parts. A metal shell is externally mounted on the insulating housing and positioned to make electrical contact with the shielding plate.

10 Claims, 12 Drawing Sheets

SHIELDED CONNECTOR ASSEMBLY

BACKGROUND OF THE INVENTION

The present invention relates to a shielded connector assembly and, more specifically, to a shielded connector assembly having a shielding plate and contact arrangement suitable for high-speed transmission of electrical signals.

DESCRIPTION OF THE PRIOR ART

Connector assemblies for high-speed transmission of electrical signals are commonly used in household game devices or personal computers. Because adjacent transmission paths used to perform high-speed transmission in connector assemblies may influence each other causing interference or crosstalk, it is desirable that adjacent transmission paths be shielded from each other. Various constructions have been devised for this purpose. An example of one such shielded connector assembly is disclosed in Japanese Patent No. 2583839. In this assembly, contacts are disposed in a plurality of rows inside an insulating housing. Characteristic impedance matching is accomplished for the transmission lines by inserting a shielding plate between adjacent contacts in the row direction. Connection parts of respective tines of the contacts and the shielding plate are inserted into a separate attachment wall attached to the insulating housing.

Another shielded connector assembly is disclosed in Japanese Unexamined Patent Publication No. 6(1994)-196224. This shielded connector assembly is not a board mount type connector, but is a "data link connector" in which contacts are also connected to electrical wires. This connector is attached to an end portion of the electrical wire or cable and has a shielding plate positioned between the contacts or terminals to prevent crosstalk.

Because the number of contacts used to achieve high-speed transmission in these connector assemblies is generally large, it becomes difficult to install the shielding plate between the contacts or terminals to reduce crosstalk as the pitch of the contacts becomes narrower. Further, for connectors similar to Japanese Patent No. 2583839, formation of a conductive pad or lands used for mounting on the attachment board becomes more difficult as the attachment pitch of the adjacent contacts becomes finer. In particular, when the connection parts of the tines of the contacts are inserted into through-holes in the attachment board and fastened by soldering, solder bridges are formed between the lands formed around the peripheries of the through-holes during soldering if the spacing of the through-holes is narrow. Additionally, because the attachment wall to which the tines of the contacts are attached is a separate part from the insulating housing, the number of parts required for assembly of the connector is increased. As a result of these problems, additional labor is required for assembly and there is an increase in the proportion of defective products causing additional repair work and increased labor and cost. Moreover, the structure is not an electromagnetic interference (EMI) resistant structure in that the shielding shell covers the entire insulating housing.

It is therefore desirable to develop a shielded connector assembly in which the shielding plate can be readily installed between the adjacent contacts having a narrow pitch to reduce crosstalk. It is also desirable to develop a shielded connector assembly that aligns the tine parts of the contacts and shielding plate without increasing the number of parts required for assembly, and to provide a shielded connector assembly that has an EMI-preventing function in addition to a crosstalk-preventing function.

SUMMARY OF THE INVENTION

This invention relates to a board mount type shielded connector assembly comprising an insulating housing having first contacts, second contacts and a shielding shell. The first contacts having first contact parts and first tine parts. The second contacts having second contact parts and second tine parts. The second contact parts having a length greater than the first contact parts and disposed alternately in at least one row with the first contact parts in the insulating housing. The second tine parts offset from the first tine parts and positioned substantially adjacent to the first tine parts in a direction perpendicular to the row. The shielding plate having a shielding surface extending in a direction perpendicular to the row. The shielding plate is attached to the insulating housing so that the shielding surface is disposed between the first and second tine parts in the row direction as a result of the offset of the second tine parts.

DETAILED DESCRIPTION OF THE PREFERRED EMBODIMENT

Figure 1:
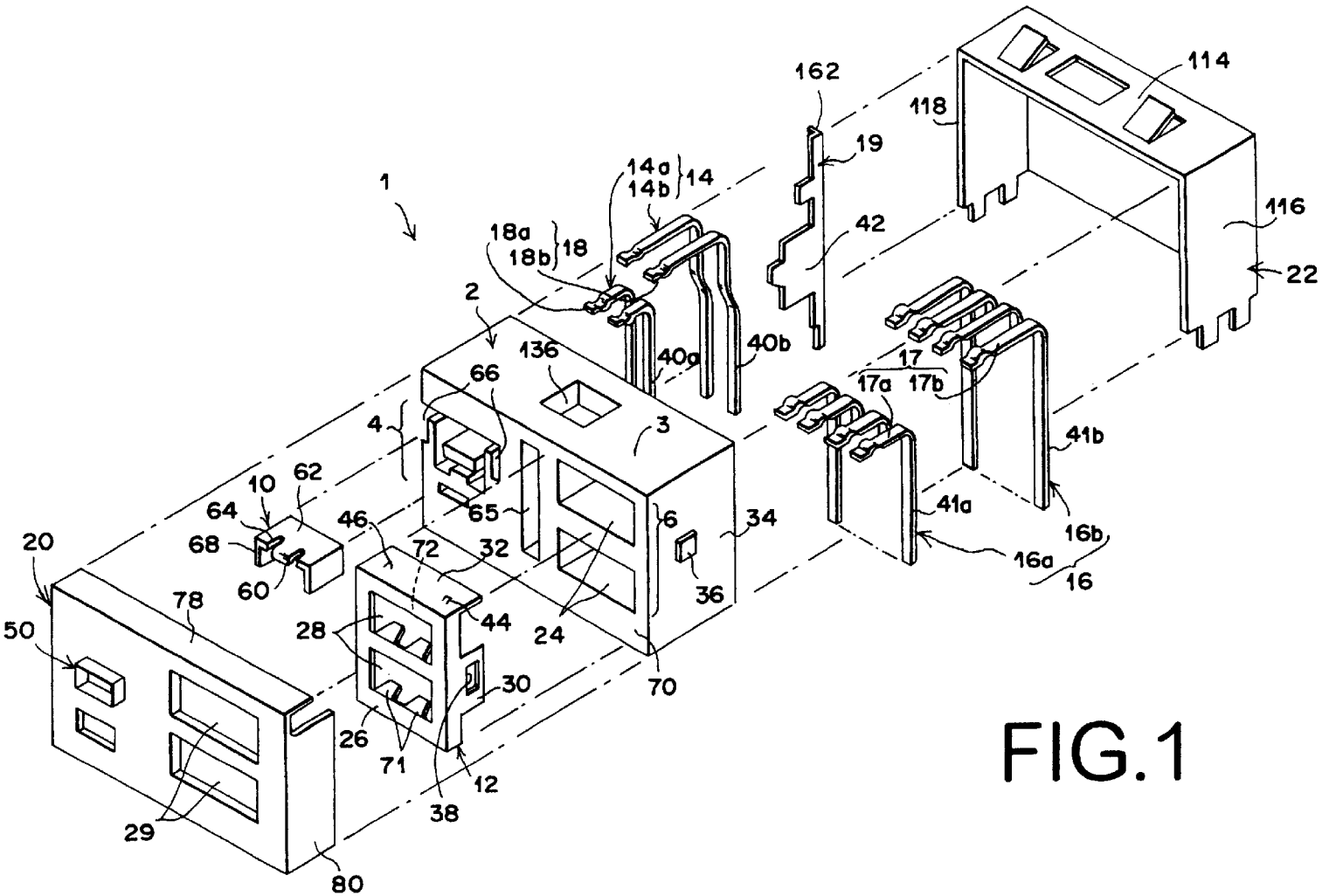
FIG. 1 is an exploded perspective view of the schematic construction of the assembly of the present invention.

A preferred embodiment of the shielded connector assembly 1 of the present invention will be described in detail below with reference to the attached figures. It should be noted that while FIG. 1 shows a schematic construction of the assembly 1, the shapes of the detailed parts do not necessarily correspond with the constructions that will be described herein. Further, when reference is made to the forward-backward direction in the following description, the side to which a mating connector (not shown) is connected is taken as the front side, and the opposite side is taken as the rear side.

Shown in FIG. 1, the assembly 1 has a substantially rectangular-solid insulating housing 2 having female first and second connector parts 4 and 6, pluralities of first and second connector part contacts 14 and 16 respectively mounted in the first and second connector parts 4 and 6 from the rear part of the housing 2, and first and second metal shells 10 and 12 respectively attached to the front parts of the first and second connector parts 4 and 6. The assembly 1 also has a shielding plate 19 attached to the rear part of the housing 2 that is disposed between adjacent first connector part contacts 14, a front shell 20 attached to the front part of the housing 2, and a rear shell 22 attached to the rear part of the housing 2. Front shell openings 29 corresponding to connector part openings 24 in the housing 2 and rectangular openings 28 in the second metal shell 12 are formed in the front shell 20, thus forming the mating parts of the second connector part 6.

In the present embodiment, the first and second metal shells 10 and 12 are respectively formed from sheet metal with thicknesses of approximately 0.2 mm and 0.3 mm. The front shell 20 and rear shell 22 are formed by stamping and forming sheet metal with respective thicknesses of approximately 0.5 mm and 0.3 mm. Further, the attachment pitch of the first connector part contacts 14 is approximately 0.8 mm. The second connector part contacts 16 have a larger attachment pitch than the first connector part contacts 14.

As shown in FIG. 1, the first connector part 4 is constructed so that the first connector part 4 satisfies the standard of IEEE1394. The second connector part 6 is constructed so that the second connector part 6 satisfies the USB standard. The first connector part contacts 14 have first connector part contact parts 18 and comprise first contacts 14*a* having first contact parts 18*a* and second contacts 14*b* having second contact parts 18*b*. The first connector part contacts 14 are disposed so that the first connector part contact parts 18 of the first connector part contacts 14 form a single row in the first connector part 4. The first connector part contacts 14 are bent into a substantially L-shape, and the first contacts 14*a* and second contacts 14*b* are alternately disposed in a single row.

Figure 8:
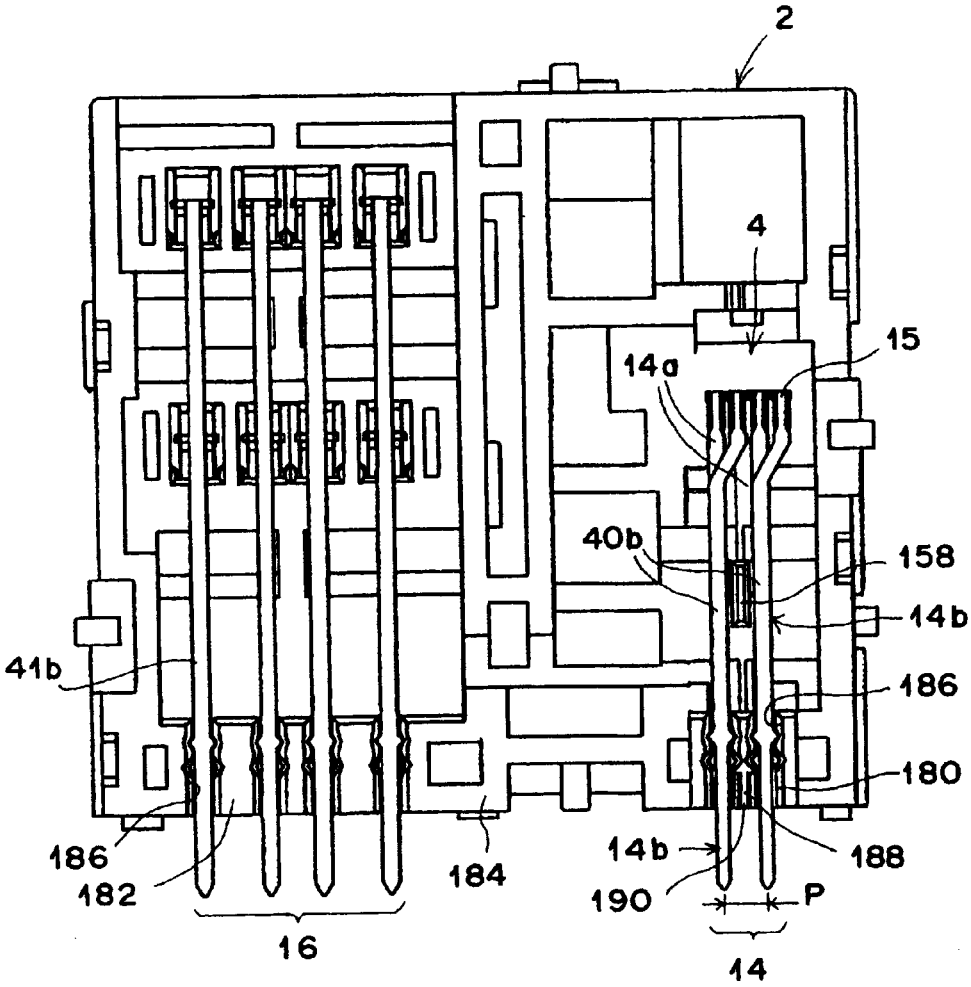
FIG. 8 is a rear view of the housing with attached contacts.

The second contact parts 18*b* of the second contacts 14*b* are longer than the first contact parts 18*a* of the first contacts 14*a*. Accordingly, second tine parts 40*b* of the second contacts 14*b* are positioned to the rear of first tine parts 40*a* of the first contacts 14*a*. Further, the second tine parts 40*b* are offset so that the second tine parts 40*b* are aligned with the first tine parts 40*a*, i.e., aligned in the forward-rearward direction perpendicular to the row direction, as shown in FIG. 8. The shielding plate 19 has a shielding surface 42 that extends in the forward-rearward direction. The shielding surface 42 is disposed in a space that is located in the vicinity of the first and second tine parts 40*a*, 40*b* and is formed in the row direction as a result of the second tine parts 40*b* being offset. The shielding surface 42 prevents crosstalk between the adjacent first connector part contacts 14.

The first metal shell 10 has a substantially squared C shape in cross section, and has a grounding tongue 60 that is cut and raised by forming slots 64 in both sides of the front end of the upper wall 62. The grounding tongue 60 is bent inward at an inclination. The grounding tongue 60 contacts the shell of the mating male connector (not shown) to establish a ground connection. The first metal shell 10 is inserted and attached in cut-outs 66 formed in the housing 2 in the upper part of the first connector part 4. In this case, the front end of the first metal shell 10 and the front surface 70 of the housing 2 are substantially coplanar. One side wall 68, positioned on the outside of the first metal shell 10, is exposed on the outside of the housing 2. The exposed side wall 68 contacts the front shell 20 as will be described in detail below.

In the second connector part 6, the connector part openings 24 that accommodate the mating male connectors (not shown) are formed above and below in the housing 2. Fourth contacts 16*b* are disposed in the upper connector part opening 24, and third contacts 16*a* are disposed in the lower connector part opening 24. The second metal shell 12 attached to the second connector part 6 has a face plate 26 having two rectangular openings 28 formed in positions corresponding to the connector part openings 24, and four tabs 30, 32 extending rearward from the face plate 26 as integral parts. The tabs 30 have rectangular openings 38. One of the rectangular openings 38 engages with a rectangular projection 36 that protrudes from the side surface 34 of the housing 2. As shown in FIG. 1, the tab 30 on the opposite side is arranged so that the tab 30 engages with a projection (not shown) located inside a groove 65 in the housing 2 in a position corresponding to the tab 30. The second metal shell 12 is fastened to the housing 2 as a result of the engagement. The rectangular openings 28 in the second metal shell 12 have the same shape as the connector part openings 24 in the housing 2. Two grounding tongues 71 are formed on the lower edge of each rectangular opening 28. The grounding tongues 71 are oriented inward at an inclination, and a single tongue 72 (hidden from view in FIG. 1) is similarly formed on the upper edge of each rectangular opening 28 so that the single tongue 72 is oriented inward at an inclination. When the mating connector (not shown) is connected, the grounding and single tongues 71 and 72 contact the outer shell of the mating connector (not shown) to establish a ground connection.

When the front shell 20 is externally mounted on the housing 2, the front shell 20 contacts the second metal shell 12 to establish electrical continuity between the second metal shell 12 and the front shell 20. The electrical continuity may be established by contact between the front surface of the second metal shell 12 and the inside surface of the front shell 20 or may be established by providing a projection 46 and/or a cut and raised tongue 44 on the upper tab 32 of the second metal shell 12 to establish positive contact with the front shell 20.

Figure 2:
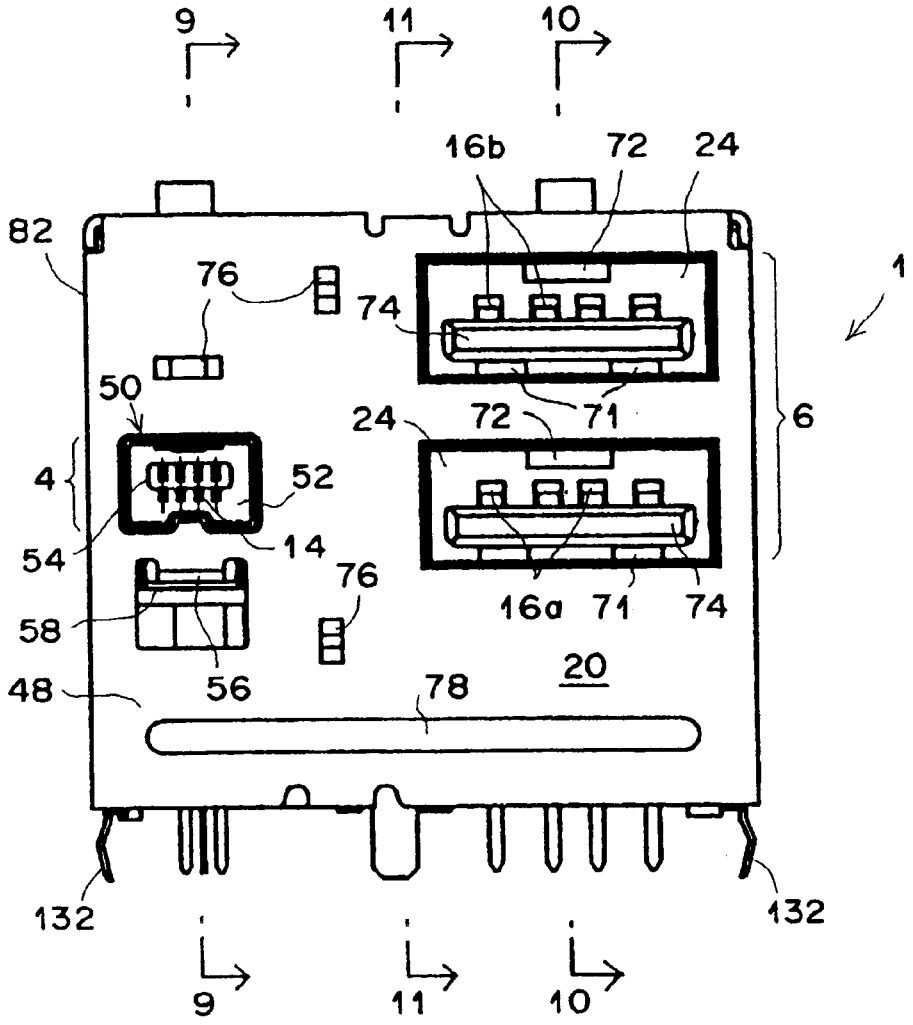
FIG. 2 is a front view of the assembly shown in FIG. 1.
Figure 9:
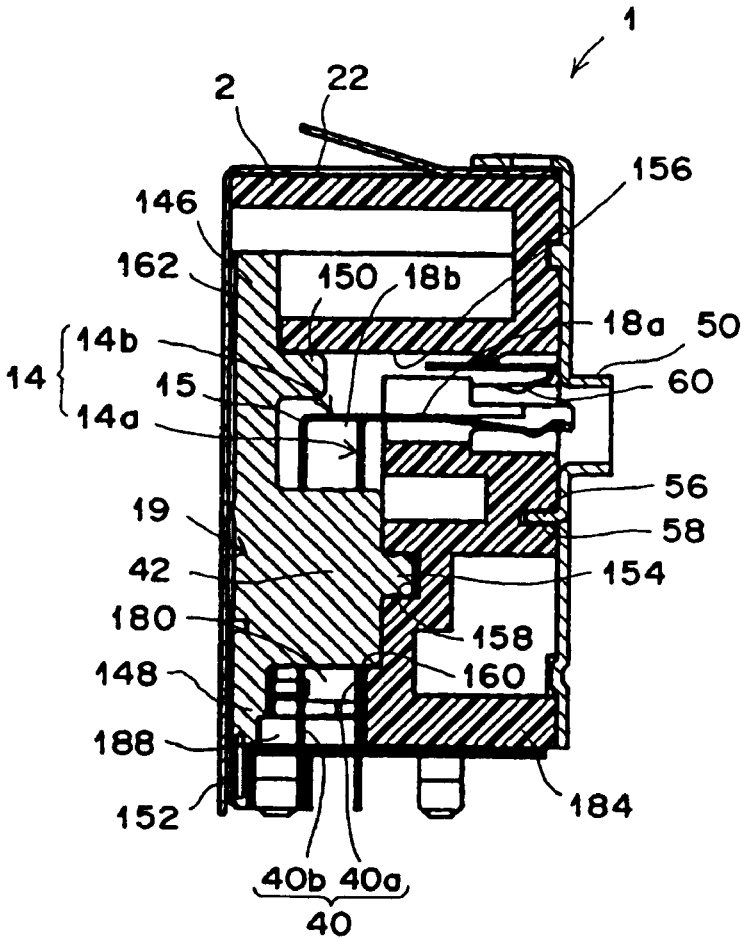
FIG. 9 is a sectional view of the assembly along line 9—9 in FIG. 2.

The assembly 1 will now be described in greater detail with reference to FIGS. 2 through 7. As shown in FIG. 2, a substantially rectangular mating part 50 protrudes from the flat main surface of the front shell 20 in a position corresponding to the first connector part 4. A mating opening 52 mated with the mating connector (not shown) is formed in the mating part 50. Inside the mating opening 52, a flat-plate part 54 extends in the horizontal direction. First connector part contacts 14 provided on the flat-plate part 54 can be seen inside the first connector part 4. A tongue 56 is cut and raised and extends rearward on the main surface 48 beneath the mating part 50. The tongue 56 is press-fitted in a slot 58 in the housing 2 and is used to position the front shell 20 in the vertical and left-right directions in FIG. 2. The tongue 56 prevents positional deviation between the mating part 50 and the housing 2 caused by wrenching of the mating connector (not shown) that is passed through the mating part 50, as shown in FIG. 9. This ensures accurate positioning since the mating part 50 of the first connector part 4 is constructed by means of a front shell 20 that is separate from the housing 2.

As shown in FIG. 2, a flat-plate part 74 extends in the direction of width of each connector part opening 24, i.e., in the horizontal direction in FIG. 2, and protrudes toward the front inside each connector part opening 24 of the second connector part 6. The second connector part contacts 16 (16*a*, 16*b*) are disposed on the upper surface of the flat-plate part 74. The tongues 71 and 72 protrude slightly into the interior of each connector part opening 24 from the upper and lower edges of each connector part opening 24. Oblong recesses 76 and a recessed bead 78 that extends across substantially the entire width of the main surface 48 in the lower part of the main surface 48 are formed in the main surface 48 of the front shell 20. The recesses 76 and the bead 78 position the front shell 20 with respect to the housing 2 by engaging with corresponding grooves (not shown) formed in the front surface 70 of the housing 2.

As shown in FIGS. 3 through 6, the front shell 20 has an upper wall 78 and side walls 80 and 82. The upper wall 78 and side walls 80 and 82 are positioned on the outside of the front part of the housing 2, and portions of the upper wall 78 and side walls 80 and 82 are fastened to the housing 2 by partial crimping. The conditions of the crimping will be described in detail below with reference to FIGS. 3 through 6. A first small part 92 extends rearward and is formed in a position that is shifted slightly to one side from the center of the upper wall 78. Cut-outs 84 and 86 are formed on both sides of the first small part 92 so that the first small part 92 is made bendable. A second small part 94 is similarly formed by cut-outs 86, 86 in the side wall 80, and a third small part 96 is also similarly formed in the side wall 82. Further, a fourth small part 98 is provided to protrude from the lower end 100 of the front shell 20.

Slots 90 extending in the forward-rearward direction are formed in the approximate centers of the small parts 92 through 98. Recesses 102 through 108 are formed in the front surface 70 of the housing 2 in respective positions corresponding to the small parts 92 through 98, and the respective small parts 92 through 98 are fastened by crimping so that the small parts 92 through 98 can bend with respect to the recesses 102 through 108. Ridges 110, of a length that engage with slots 90 formed in the small parts 92 through 98, are formed in portions of the housing 2 that correspond to the slots 90. Accordingly, the front shell 20 is fastened and positioned securely. After the front shell 20 has been fastened to the housing 2, a gap allowing only the accommodation of the rear shell 22 is maintained between the outer walls of the housing 2 and the upper wall 78 and side walls 80 and 82 of the front shell 20.

Figure 3:
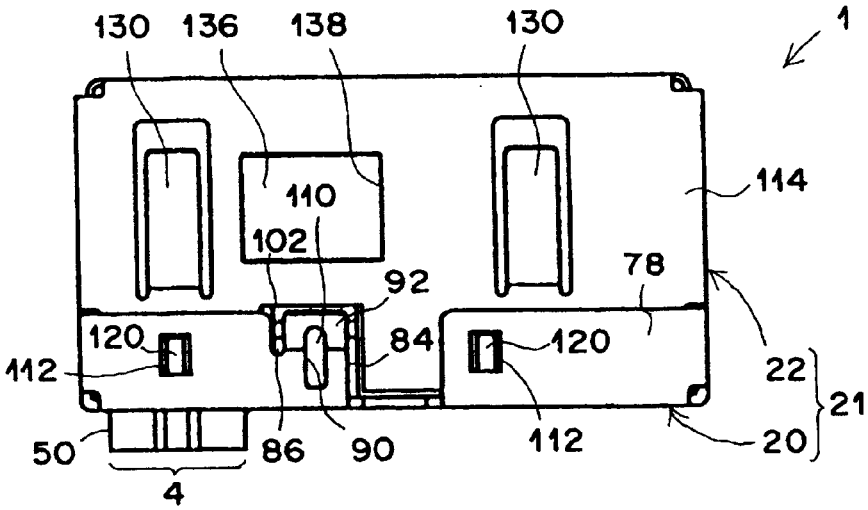
FIG. 3 is a plan view of the assembly shown in FIG. 1.
Figure 4:
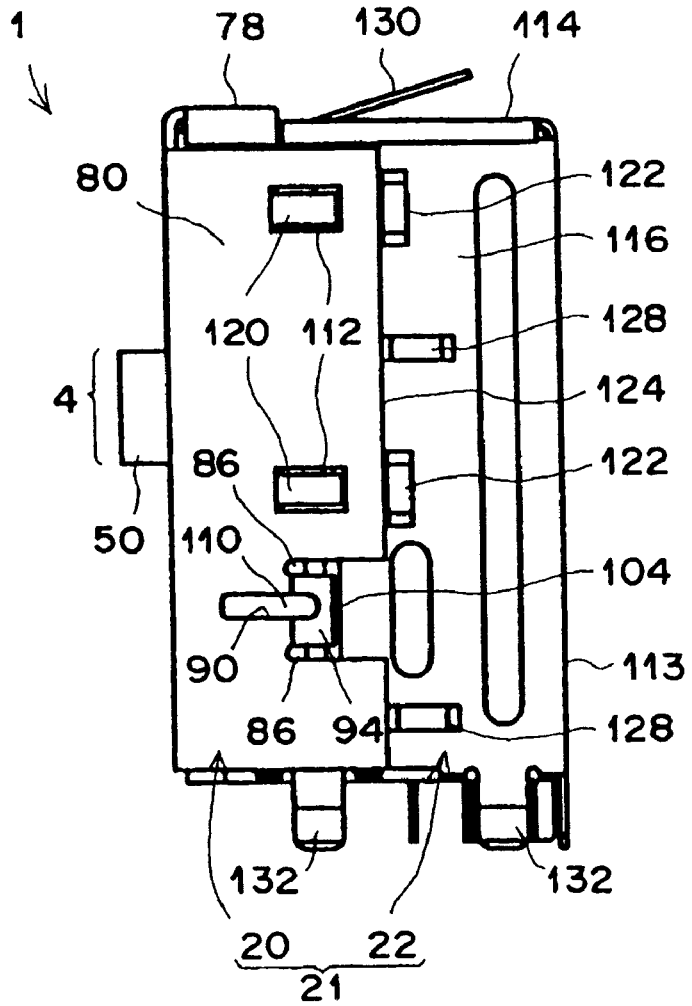
FIG. 4 is a right-side view of the assembly shown in FIG. 1.
Figure 5:
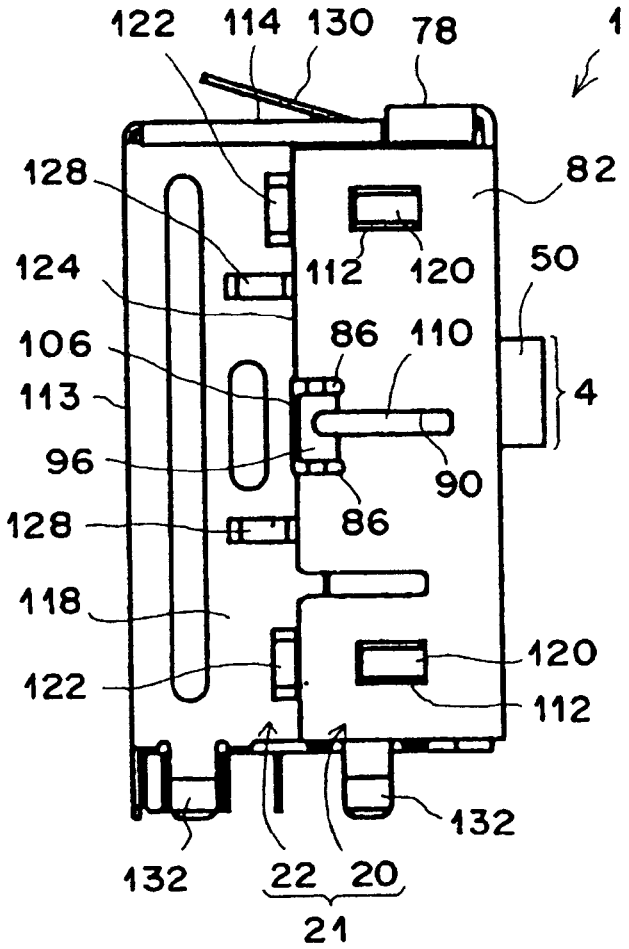
FIG. 5 is a left-side view of the assembly shown in FIG. 1.
Figure 6:
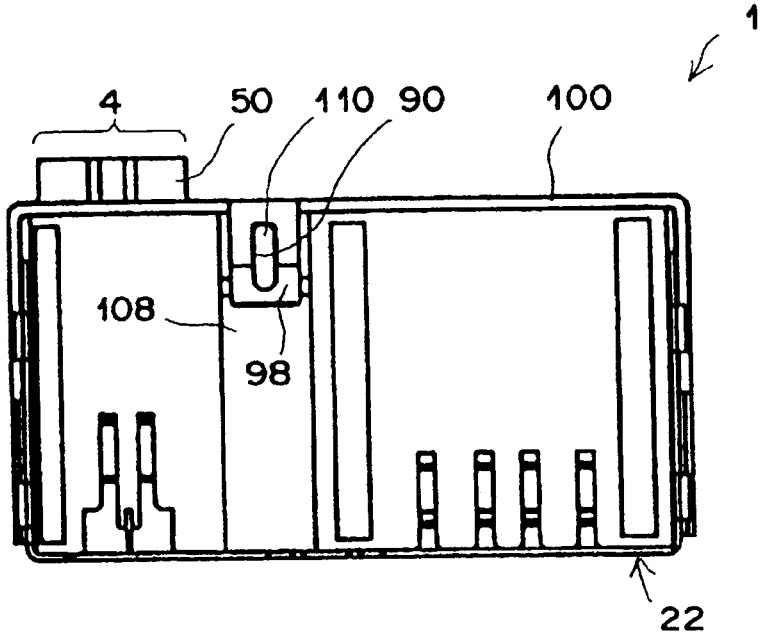
FIG. 6 is a bottom view of the assembly shown in FIG. 1.

As shown in FIGS. 3 through 5, small rectangular engaging holes 112 extend slightly in the forward-rearward direction and are formed in the upper wall 78 and side walls 80 and 82 of the front shell 20. Two engaging holes 112 are formed in each wall for mechanical engagement with the rear shell 22.

The rear shell 22 will now be described in greater detail with reference to FIGS. 3 through 7. Shown in FIG. 7, the rear shell 22 has a main surface 113, an upper wall 114 and side walls 116 and 118 that extend forward from the main surface 113. Latching arms 120 that are slightly smaller than the engaging holes 112 are formed on the upper wall 114 and side walls 116 and 118 in positions that correspond to the engaging holes 112 when the rear shell 22 is attached to the housing 2. The latching arms 120 are formed by being cut and raised so that the latching arms 120 extend upward at an inclination toward the rear. Accordingly, when the respective walls of the rear shell 22 are disposed inside the corresponding walls of the front shell 20, the latching arms 120 engage with the engaging holes 112, so that the rear shell 22 is fastened to the front shell 20. Further, protruding parts 122 positioned at the rear ends 124 of the side walls 80 and 82 of the front shell 20 protrude from the side walls 116 and 118 of the rear shell 22 by embossing. The positioning of the rear shell 22 is also securely accomplished by means of the protruding parts 122. The mechanical engagement of the front shell 20 and rear shell 22 establishes an electrical connection that forms an integral shielding shell 21 covering the housing 2.

Ridges 128 are formed on the side walls 116 and 118 and protrude inward and extend in the forward-rearward direction. The ridges 28 slide through the interiors of corresponding guide grooves (not shown) that extend in the forward-rearward direction of the housing 2 when the rear shell 22 is mounted on the housing 2 to ensure that the rear shell 22 can be smoothly mounted on the housing 2.

The contact beams 130 are cut and raised from the upper wall 114 of the rear shell 22. The contact beams 130 extend rearward at an inclination and contact the device housing body (not shown) in which the assembly 1 is mounted to establish a ground connection. Attachment legs 132 protrude from the lower edges of the side walls 116 and 118 of the rear shell 22. Two attachment legs 132 protrude from each side wall. The attachment legs 132 are bent into a shallow V-shape that bows outward and are inserted into corresponding holes in the attachment board (not shown). As shown in FIG. 5, the portion of the rear shell 22 that is located directly above the attachment legs 132 on the front side is supported by the front shell 20, which has a large thickness. Accordingly, the attachment legs 132 do not easily open to the outside, so that alignment with the apertures in the board into which the attachment legs 132 are inserted can be maintained.

As shown in FIG. 3, an opening 138 is formed in the upper wall 114 of the rear shell 22 in a position corresponding to a square hole 136 formed in the upper wall 3 of the housing 2. A portion of the device (not shown) engages with the square hole 136 (opening 138) and supports the assembly 1, so that no excessive stress is applied to the board attachment parts, i.e., tine soldering parts (not shown), of the assembly 1 when the mating connector (not shown) is inserted and removed.

Figure 7:
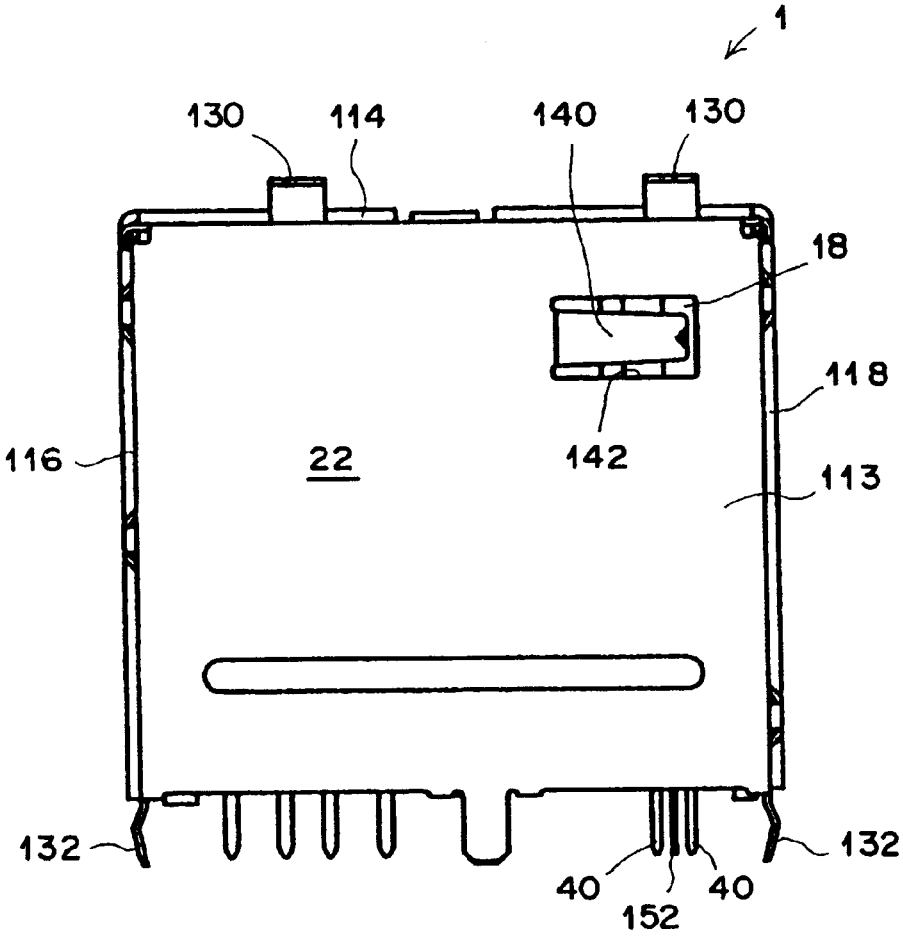
FIG. 7 is a rear view of the assembly shown in FIG. 1.

As shown in FIG. 7, a contact beam 140 is formed by an opening 142 in a position corresponding to the shielding plate 19 of the first connector part 4. The contact beam 140 is formed so that the contact beam 140 extends horizontally and inward toward the side wall 118 (toward the front) in the main surface 113 of the rear shell 22. The contact beam 140 makes elastic contact with the rear end of the shielding plate 19 and is electrically connected to the shielding plate 19. As a result, the shielding plate 19 and the shielding shell 21 that covers the housing 2 form an integral unit, so that the first connector part 4 is also protected against EMI.

The details of the positional relationship between the shielding plate 19 and the first connector part contacts 14 will now be described with reference to FIGS. 8 and 9. As shown in FIG. 8, the second tine parts **40*b* of the second contacts 14*b* on the rear side of the first connector part 4 are offset in the vicinity of bent parts 15 toward the tine parts 40*a*, shown in FIG. 9, of the first contacts 14*a* on the front side, so that the second tine parts 40*b* are lined up to the rear of the tine parts 40*a*. As a result, the spacing between the second tine parts 40*b* and the spacing between the tine parts 40*a* in the row direction (the left-right direction in FIG. 8) are the same, and the pitch P in the left-right direction is twice the pitch of the first connector part contact parts 18. Accordingly, the shielding plate 19 can be inserted into the space between the second tine parts 40*b* that is obtained as a result of the offset. As shown in FIG. 9, the second contact parts 18*b* of the second contacts 14*b* are longer than the first contact parts 18*a* of the first contacts 14*a* and the shielding surface 42 of the shielding plate 19 is disposed between the tine parts 40 of the first connector part contacts 14**.

As shown in FIG. 9, the shielding plate 19 has a substantially rectangular flat-plate-form shielding surface 42.

Respective extension parts 146 and 148 extend upward and downward from the rear side of the shielding surface 42 and are integrally formed by stamping from a single metal plate. The extension part 146 is formed so that the extension part 146 is longer than the extension part 148. A first tab 150 extending in the same direction as the shielding surface 42 is formed in the approximate center of the extension part 146. A tine 152, used for board attachment, extends downward from the lower end of the extension part 148 and is formed on the extension part 148. A second tab 154, similar to the first tab 150, is formed on the tip end of the shielding surface 42. When the shielding plate 19 is attached facing forward from the rear part of the housing 2, the first tab 150 engages with the inside wall 156 of the housing 2. The second tab 154 is press-fitted in a recessed part 158 of the housing 2, so that the lower part of the front end of the shielding surface 42 is seated on a step part 160 of the housing 2. As a result, the shielding plate 19 is fastened to the housing 2 so that the shielding surface 42 partially shields the tine parts 40*a* and 40*b*. It is desirable that a contact surface 162 which is perpendicular to the shielding surface 42 be formed in an L-shape on the rear part of the shielding plate 19 so that the contact surface 162 runs from the approximate center of the shielding plate 19 (with respect to the direction of height) to the upper end of the shielding plate 19. The contact surface 162 contacts the contact part 140 of the rear shell 22, so that the contact surface 162 is electrically connected to the rear shell 22.

Figure 10:
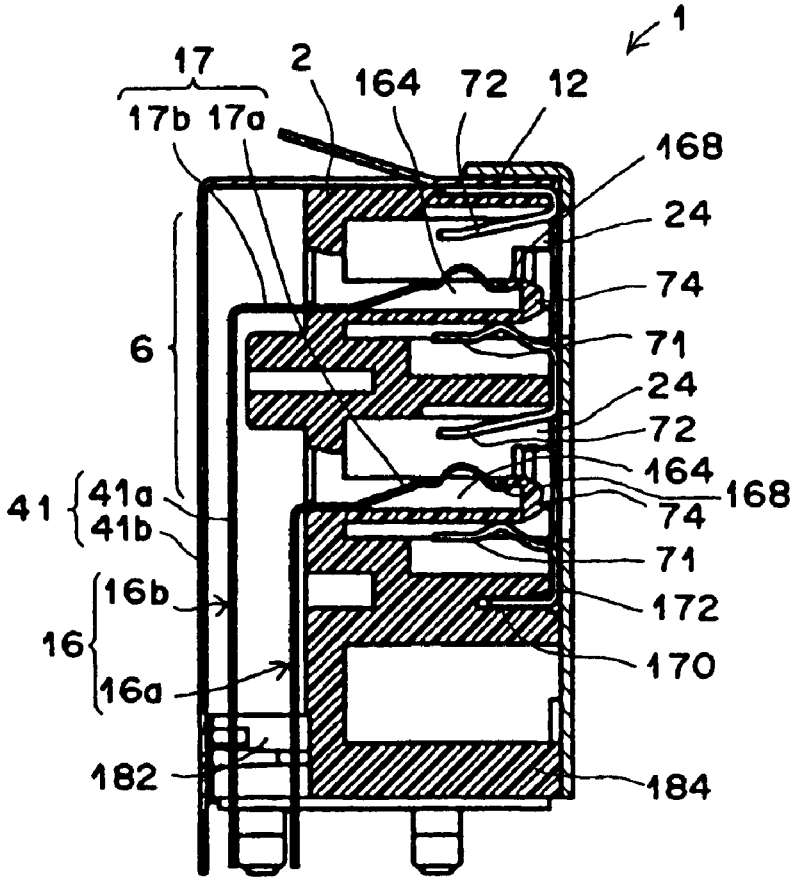
FIG. 10 is a sectional view of the assembly along line 10—10 in FIG. 2.

The internal structure of the second connector part 6 will now be described in greater detail. As shown in FIG. 10, the flat-plate parts 74 protrude as integral parts of the housing 2 into the upper and lower openings 24 of the second connector part 6. Contact accommodating grooves 164 extend in the forward-rearward direction and are formed in the respective flat-plate parts 74. The second connector part contact parts 17 of the L-shaped second connector part contacts 16 are accommodated in the contact accommodating grooves 164. In this case, the tip ends of the second connector part contact parts 17 are anchored to the inside walls 168 of the accommodating grooves 164, so that the second connector part contact parts 17 are held in a state in which the second connector part contact parts 17 are urged upward. Accordingly, the second connector part contact parts 17 can be provided to flex elastically upward and downward by the insertion and removal of the mating connectors (not shown). Further, the tongues 72 of the second metal shell 12 are disposed facing inward at an inclination inside the openings 24. A tab 170 on the lower end of the second metal shell 12 is inserted into a groove 172 in the housing 2, to position the second metal shell 12. The front shell 20 and second metal shell 12 overlap and contact each other.

Figure 11:
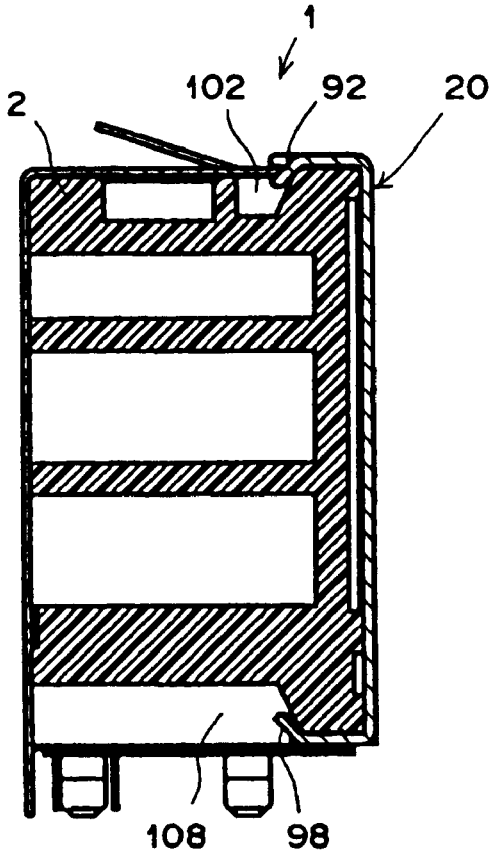
FIG. 11 is a sectional view of the assembly along line 11—11 in FIG. 2.

The crimping of the front shell 20 will now be described with reference to FIG. 11. As shown in FIG. 11, the upper and lower small parts 92 and 98 of the front shell 20 are respectively bent and crimped inside the recesses 102 and 108 of the housing 2. The other small parts 94 and 96 are crimped in a similar state (the sectional view is omitted).

The tine holding parts will now be described in greater detail. Shown in FIGS. 8 and 9, the tine holding part 180 is formed as an integral part of the bottom wall 184 of the housing 2 in the lower part of the housing 2, and holds the tine parts 40 of the first connector part contacts 14. The tine holding part 182, shown in FIGS. 8 and 10, holds the tine parts 41 of the second connector part contacts 16. The tine holding parts 180 and 182 hold the tine parts 40 and 41 in positions corresponding to the through-holes in the boards, and have holding grooves 186 that open to the rear. The tine parts 40 and 41 are aligned in positions corresponding to the through-holes (not shown) of the board by the tine holding parts 180 and 182.

A shielding plate holding part 188 is formed between the two holding grooves 186 in the first connector part 4. Shown in FIG. 8, the shielding plate holding part 188 has a holding groove 190 that opens to the rear in the same manner as the holding grooves 186. The extension part 148 that extends downward from the shielding plate 19 and is accommodated inside the holding groove 190 to position the tine 152 that extends downward as a continuation of the extension part 148. Since the gap between the second tine parts 40*b*, 40*b* of the adjacent first connector part contacts 14 is expanded from approximately 0.8 mm to approximately 1.6 mm as a result of the offset of the second tine parts 40*b*, the shielding plate 19 can be appropriately disposed without contacting the adjacent first connector part contacts 14 to prevent crosstalk.

Figure 12A:
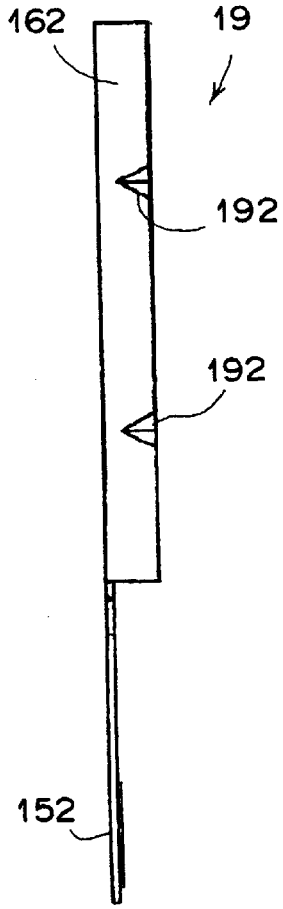
FIG. 12A is a rear view of the shielding plate.
Figure 12B:
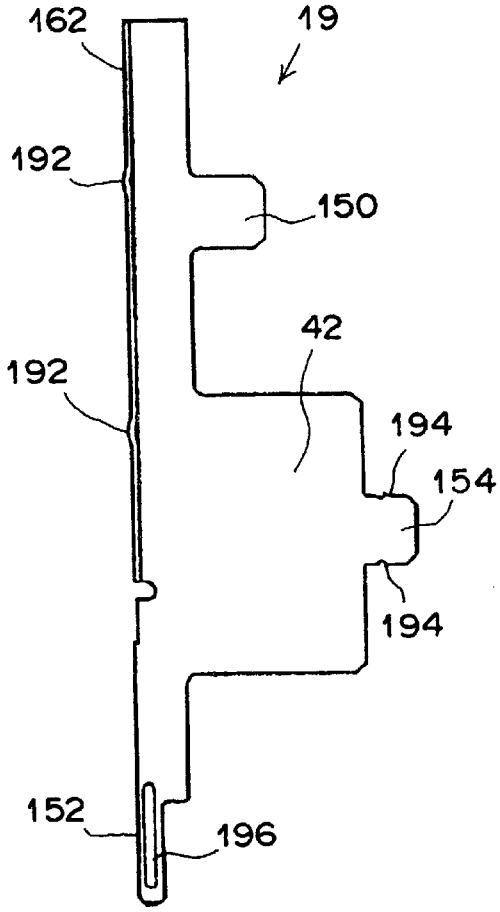
FIG. 12B is a side view of the shielding plate.

The shielding plate 19 will now be described in greater detail with reference to FIGS. 12*a* and 12*b*. Two triangular projections 192 formed by embossing are formed on the contact surface 162 of the shielding plate 19 in positions that are separated above and below. Barbs 194 are formed on both side edges of the second tab 154 of the shielding surface 42 so that the second tab 154 interferes and engages with the housing 2. A reinforcement bead 196 is formed on the tine 152 along the direction of length of the tine 152. The triangular projections 192 are formed to ensure secure contact with the rear shell 22, and the barbs 194 are formed to ensure secure fastening with the housing 2.

As described above, the plate thickness of the front shell 20 is approximately 0.5 mm, so that the front shell has sufficient strength. Accordingly, following crimping, the bent state of the front shell 20 is securely maintained without loosening. If tongues were constructed by means of the front shell 20 instead of using the tongues 71 and 72 of the second metal shell 12, appropriate elastic deformation in response to the insertion and removal of the mating connector (not shown) would be unachievable. Thus, insertion and electrical connection of the male connectors (not shown) would be impossible, since tongues with the plate thickness of as much as 0.5 mm have limited flexibility. Resultantly, the second metal shell 12 and front shell 20 are constructed as separate parts. Further, it will be appreciated by those skilled in the art that the fastening of the front shell 20 to the housing 2 need not necessarily be accomplished by crimping, but may be accomplished by other means such as fastening by latching engagement.

The exposed side wall 68 of the first metal shell 10 contacts the inside surface of the side wall 82 of the front shell 20 and is electrically connected to the front shell 20 as a result of the mounting of the front shell 20. The front shell 20 is also electrically connected to the rear shell 22, thus forming the shielding shell 21 that covers the housing 2. As a result, in addition to crosstalk prevention, the first connector part 4 can also be protected against EMI.

Accordingly, the shielded connector assembly advantageously allows the installation of a shielding plate between adjacent contacts, even in the case of contacts with a narrow pitch to reduce crosstalk. A shielded connector assembly is also obtained which makes it possible to align the tine parts of the contacts and the shielding plate without increasing the number of parts required. Further, in cases where the shielded connector assembly of the present invention is constructed so that a metal shielding shell is externally mounted on the insulating housing, and the shielding plate makes electrical contact with the shell, a shielded connector assembly is obtained which has an EMI-preventing function in addition to a crosstalk-preventing function.

We claim:

1. A board mount type shielded connector assembly comprising:

an insulating housing;

first contacts having a first length, first contact parts and first tine parts;

second contacts having second contact parts having a second length greater than the first length and disposed alternately in at least one row with the first contact parts in the insulating housing, and second tine parts offset from the first tine parts and positioned substantially adjacent to the first tine parts in a direction perpendicular to the row; and a shielding plate having a shielding surface extending in a direction perpendicular to said row, and attached to the insulating housing so that the shielding surface is disposed between the first and second tine parts in the row direction as a result of the offset of the second tine parts.

2. The shielded connector assembly of claim 1, further comprising a metal shell externally mounted on the insulating housing and positioned to make electrical contact with the shielding plate.

3. The shielded connector assembly of claim 1, further comprising tine holding parts integrally formed in the insulating housing to align and hold the first and second tine parts.

4. The shielded connector assembly of claim 3, further comprising a metal shell externally mounted on the insulating housing and positioned to make electrical contact with the shielding plate.

5. The shielded connector assembly of claim 1, wherein the shielding plate has a tab for engagement with the insulating housing.

6. The shielded connector assembly of claim 5, wherein the tab has a barb for secure engagement with the insulating housing.

7. The shielded connector assembly of claim 1, wherein the shielding plate has a tine for engagement with the insulating housing.

8. The shielded connector assembly of claim 7, wherein the tine has a reinforcement bead formed along the tine that engages the insulating housing.

9. The shielded connector assembly of claim 1, further comprising a rear shell.

10. The shielded connector assembly of claim 9, wherein the shielding plate has projections that ensure connection to the rear shell.

* * * * *

UNITED STATES PATENT AND TRADEMARK OFFICE

CERTIFICATE OF CORRECTION

PATENT NO. : 6,604,964 B2
DATED : August 12, 2003
INVENTOR(S) : Hoshino et al.

It is certified that error appears in the above-identified patent and that said Letters Patent is hereby corrected as shown below:

Title page,
Item [30], Foreign Application Priority Data, "Jan. 31, 2001 (JP).....2001-024483" should be deleted.

Signed and Sealed this

Twenty-third Day of December, 2003

JAMES E. ROGAN
*Director of the United States Patent and Trademark Office*